US006063416A

United States Patent [19]

Teasdale et al.

[11] Patent Number: 6,063,416

[45] Date of Patent: May 16, 2000

[54] PROCEDURE AND PACKAGE TO ENABLE PEG DISPLAY OF FOOD POUCH IN TENT-STYLE PAPERBOARD CARTON

[75] Inventors: Arthur C. Teasdale; Stephen P. Wilcox, both of Sun Prairie, Wis.

[73] Assignee: Kraft Foods, Inc., Northfield, Ill.

[21] Appl. No.: 09/236,874

[22] Filed: Jan. 26, 1999

[51] Int. Cl.[7] ..... A23B 4/00

[52] U.S. Cl. ..... 426/115; 426/121; 426/129; 426/411; 229/117.27

[58] Field of Search ..... 426/115, 121, 426/122, 129, 398, 411; 206/806; 229/115, 117.33, 117.34, 117.27

[56] References Cited

U.S. PATENT DOCUMENTS

| | | | |
|---|---|---|---|
| 2,319,560 | 5/1943 | Salfisberg | 206/474 |
| 2,780,353 | 2/1957 | Volckening | 206/466 |
| 2,922,568 | 1/1960 | Harker | 229/117.33 |
| 3,008,837 | 11/1961 | Kaplan | 426/110 |
| 3,339,721 | 9/1967 | Goldstein | 206/583 |
| 3,339,820 | 9/1967 | Krzyzanowski | 229/216 |
| 3,343,719 | 9/1967 | Kastamo et al. | 222/1 |
| 3,960,315 | 6/1976 | Dobbins | 229/87 |
| 4,125,633 | 11/1978 | Vander Lugt, Jr. | 426/121 |
| 4,365,458 | 12/1982 | Palmer et al. | 53/449 |
| 4,972,657 | 11/1990 | McKee | 53/411 |
| 5,083,700 | 1/1992 | Mello et al. | 229/115 |
| 5,088,617 | 2/1992 | Williams et al. | 220/403 |
| 5,295,630 | 3/1994 | Parish | 229/138 |

*Primary Examiner*—Nina Bhat
*Assistant Examiner*—Sherry A. Dauerman
*Attorney, Agent, or Firm*—Cook, Alex, McFarron, Manzo, Cummings & Mehler, Ltd.

[57] ABSTRACT

Packaging for food products is provided which combines a flexible pouch with a tent-style paperboard carton which effects display of the product in an upright orientation, such as suspended from a merchandiser peg. The flexible pouch has a folded-over mouth portion which provides a folded width that is less than the width of the tent-style carton and preferably also less than the width of the pouch along its unfolded portion.

16 Claims, 4 Drawing Sheets

PROCEDURE AND PACKAGE TO ENABLE PEG DISPLAY OF FOOD POUCH IN TENT-STYLE PAPERBOARD CARTON

BACKGROUND OF THE INVENTION

This invention generally relates to packaging for food products, especially food product strips and sliced meats, as well as to a procedure for enabling such packaging. More particularly, the packaging combines a food-containing flexible pouch within a tent-style carton. The size and shape of the flexible pouch, as well as the quantity, weight and volume of food within the pouch, are the same as those of those designed, sized and shaped as packages for retail sale without a paperboard carton thereover. In addition, the assembly of the pouch and carton is sized arid shaped so as to fit within the same retail space which is intended to accommodate the dimensions of a stand-alone pouch which is not within a carton.

Upright display merchandisers for food products have very strict display face dimension limits. In order to avoid wasting valuable retail display space, the width of each product must divide evenly into the total shelf facing width. For example, a shelf having a total facing width of 30 inches will evenly accommodate six rows of food packages if those rows each fit within a maximum facing width of five inches. Of course, in this example, a width of not much less than five inches is also desired in order to make maximum use of the available space. What cannot be tolerated in this situation, however, is having the food package require even only slightly more than five inches (in this example) of lateral shelf space for merchandiser facing width.

In order to avoid improper alignment of packages and in order to avoid disruption of neighboring packages when a package is removed from one row, a typical upright display merchandiser has a plurality of elongated, generally horizontal pegs, often in combination with a plurality of demarcation members which specifically define respective rows, with the respective pegs being generally horizontally centered between the respective demarcation members. Certain merchandisers can provide demarcation members which take the form of self-contained organizers. In a simpler form, these demarcation members take the form of dividers which are positioned at evenly spaced locations along the length of the shelf. In the example presented above, each such divider, wall, or demarcation member would be spaced every five inches (on centers) in order to accommodate six rows of packages within a 30 inch facing width shelf. In this instance, pouches (when used without an over-carton) are sized to fit within the available space. The flexibility of pouches provides some extra accommodation to these size constraints when the pouches are used in a stand-alone manner. The advantage of this accommodative aspect of flexible pouches is forfeited when the pouch is placed within an outer carton which maintains its dimensions unless subjected to extraordinary and damaging forces.

In many upright display merchandiser situations, package depth also is limited. Because of this, often it is not possible to make a packaged product which is narrower and proportionally deeper in order to accommodate the same weight of food product in a narrower package. This option is not even conceptually available when it is decided that the same pouch size is to be used whether for a pouch-only package (cartonless pouch) or for a package having the pouch positioned within a carton. Such a requirement for same pouch size can be done for economic, capital equipment and convenience reasons.

The size accommodation issue can be more restrictive when the food package products are to be peggable. When a multiple-component package combination of a pouch and a carton are to be peggable, in many situations, this requires a peg-accommodation hole which must be provided in both the pouch and the carton, and which holes must be aligned in one form or another. This accommodation issue also is rendered more difficult when the upper portion of the pouch designed for gaining access to the food product includes a strip such as a zipper-type strip which permits access into and reclosure of the pouch cavity. Such strips often also add thickness to the pouch, requiring a greater volume in order to accommodate the strip, such as between closely spaced opposing panels of a carton. This added bulk and stiffness which is characteristic of a strip-containing mouth or access portion of a pouch is the minimum spacing required between carton walls, which is especially problematic in tent-style cartons where the opposing upper wall portions engage each other or are very closely spaced from each other.

The present invention addresses the difficulties and concerns which occur when a pouch which is designed to maximize space available in a peg display or in an upright display merchandiser is to be made available in a combined package wherein the pouch is positioned within a non-flexible carton which is rigid or semi-rigid, at Least in a longitudinal orientation. These difficulties and concerns are addressed by the present invention without having to modify the size or shape of the pouch or the weight, sizing or orientation of the food within the pouch.

SUMMARY OF THE INVENTION

In accordance with the present invention, a food package is provided which combines a food-containing flexible pouch with a tent-style carton within which the pouch is contained. The carton has a width which is not greater than the width of the pouch which generally corresponds to that of the access opening of the pouch, while the height of the pouch as manufactured is significantly greater than its width. In the preferred arrangement, the carton has a peg hole for suspension from a retail peg display, and the pouch has a closure arrangement which is bulkier than like portions of the pouch. During the packaging procedure, the closure area is folded back about 180 degrees, and the pouch is turned or rotated 90 degrees so its closure area is in line with a side wall of the carton and then inserted into the tent-style carton. In the thus-assembled combination, the access portion of the pouch having the closure portion folded back on itself extends between the top, close-fitting edge of the tent-style carton and the bottom, deeper bottom face of the carton. With this arrangement only a minimal end portion of the pouch folded area is within the close-fitting top portion of the tent-style carton.

It is accordingly a general object of the present invention to provide an improved food package combination of a food-containing flexible pouch having a folded-over portion, together with a tent-style carton enclosing the flexible pouch.

Another object of the present invention is to provide an improved pouch and carton combination which maintains display facing size commonality with a substantially identical pouch having the same contents, but which is displayed as an uncartoned pouch.

Another object of this invention is to provide an improved food package combination of a food-containing flexible pouch and a tent-style carton, wherein the flexible pouch has a reclosure strip, and the carton has a hole for a peg display arrangement, while the pouch excludes such a hole for peg accommodation.

Another object of present invention is to provide a procedure which enables the preparation of a package for retail peg dispensing and which positions a flexible food pouch in a tent-style paperboard carton, such folding and rotating the pouch enables the pouch to fit within the carton at a pouch orientation which is rotated 90 degrees from its uncartoned orientation.

Another object of the present invention is to provide a procedure for providing packages combining a food-containing pouch within a tent-style paperboard carton, which procedure maintains the flexibility of making both the cartoned pouch and an uncartoned pouch on a single pouch-forming machine, thereby overcoming an otherwise cost-prohibitive and space-prohibitive conflict between two production requirements, one for an uncartoned pouch package and the other for a pouch package carton within a tent-style carton.

These and other objects, features and advantages of the present invention will be apparent from and clearly understood through a consideration of the following detailed description.

BRIEF DESCRIPTION OF THE DRAWINGS

In the course of description, reference will be made to the attached drawings, wherein.

DESCRIPTION OF THE PREFERRED EMBODIMENTS

Figure 5:
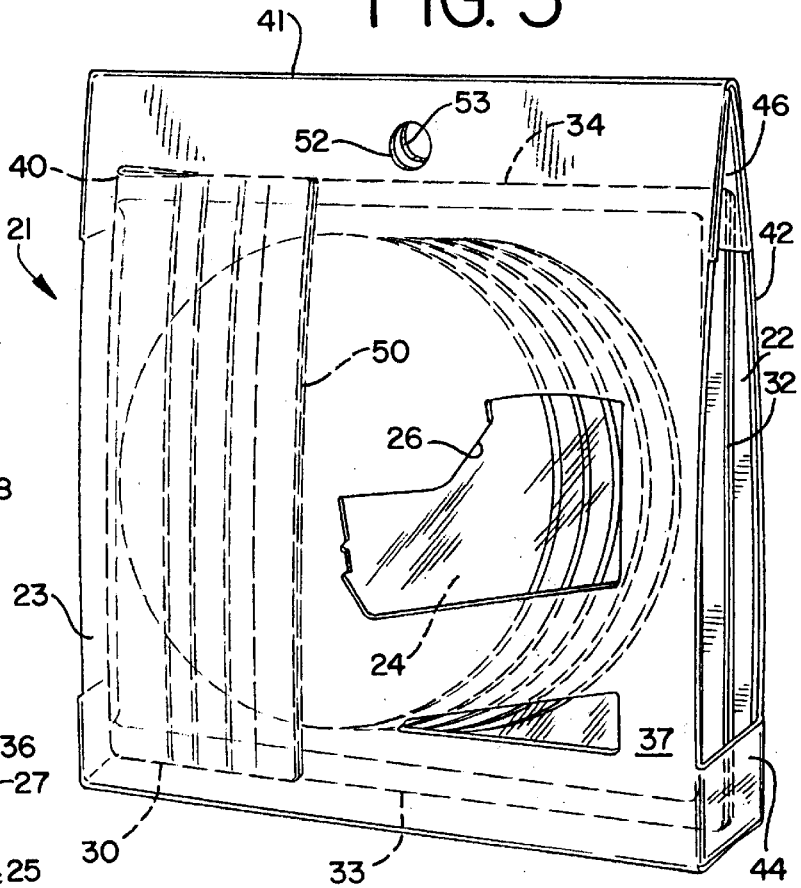
FIG. 5 is a perspective view of a preferred embodiment of the combination pouch and tent-style carton.

A preferred combination of the package according to the invention is generally illustrated at 21 in FIG. 5 and elsewhere, a flexible pouch 22 being shown positioned within a tent-style carton 23. Food product 24 is shown within the flexible pouch 22. In this illustration, a plurality of slices 25 of the food product are shown. The food items can be slices, strips, cubes, dices or shreds of luncheon meat, cold cuts, whole muscle cuts, cheese and the like. In this illustrated embodiment, slices 25 are shown, and they are shown shingled such that slices are horizontally offset from adjacent slices. In order to permit the potential purchaser and consumer to view the food product prior to purchasing, the flexible pouch 22 is generally transparent, and one or more windows 26 and/or 27 (FIG. 6 and FIG. 7) can be provided. In this illustrated embodiment, a shingled portion of the sliced array is visible through the front window 26, while less of the slices are visible through the rear window 27.

With further reference to the illustrated flexible pouch 22, a strip 28 (FIG. 7) is positioned along an access opening 29 into a product cavity 31 of the flexible pouch, the food product 24 being within this product cavity 31. It will be appreciated, in accordance with known practices, that the edge portions 32, 33 and 34 are seals which substantially permanently join the front panel 35 of the pouch to its rear panel 36. In the illustrated embodiment, the front panel is a formed panel which provides a flexible or semi-rigid shape to the pouch in order to more closely accommodate the food product 24. Rear panel 36 is shown as a non-forming side of the pouch. Instead, the front panel can be nor-forming and the rear panel can be forming, or both could be non-forming or forming.

In an important aspect of the invention, a mouth portion of the pouch 22 is delineated from the body portion of the pouch by a fold line 40. Mouth portion 30 extends from the fold line 40 to an edge 50 of the pouch 22. It will be appreciated that mouth portion 30 includes the access opening 29 and, when provided, the strip 28. This mouth portion 30 is a portion of the pouch which is folded over 180 degrees onto itself, with the product cavity 31 being essentially defined by the remainder of the pouch. This pouch portion is thus a pouch folded area. This pouch folded area or mouth portion 30 may be folded onto the front panel 35 or the rear panel 36.

Whichever fold orientation is selected, the result is a folded width FW of the pouch which is not greater than, and preferably less than the unfolded width W of the flexible pouch 22. This relationship assists in enabling the same pouch to be used as an uncartoned pouch and as the cartoned pouch in accordance with the combination of the present invention. The carton width preferably is slightly greater than the folded width FW of the flexible pouch. Typically this width of the carton is approximately equal to the unfolded width W of the flexible pouch, which is the width of the pouch when used as an uncartoned pouch.

It will be appreciated that strip 28 allows for selective opening and reclosing of the flexible pouch 22 after it is removed from the carton and the folded area 33 is unfolded, in order to provide for removal of a portion or all of the food from the product cavity 31. A typical strip having these reclosure attributes is a so-called zipper strip, which may take on any one of various structures. For example, a zipper strip can comprise elongated profiles which are complementary in shape such that one profile is received into the other profile. Other reclosure strips include slidable components. Specific details of the strip will be appreciated by those of ordinary skill in the art of flexible pouches. Whatever the exact structure, strip 28 has a stiffness and typically a bulkiness or thickness which are greater than the stiffness and bulkiness of the remainder of the flexible pouch 22 itself.

Tent-style paperboard carton 23 has a front face 37, a back face 38, and a bottom face 39. Also included is a top edge 41. Respective edges of the front face 37, the back face 38, the bottom face 39 and the top edge 41 combine to delineate a pair of opposing end areas 42, 43, each of which has a generally triangular configuration as can be noted in FIG. 5 and FIG. 6. In the illustrated embodiment, partial end panels 44, 45 are included.

Figure 8:
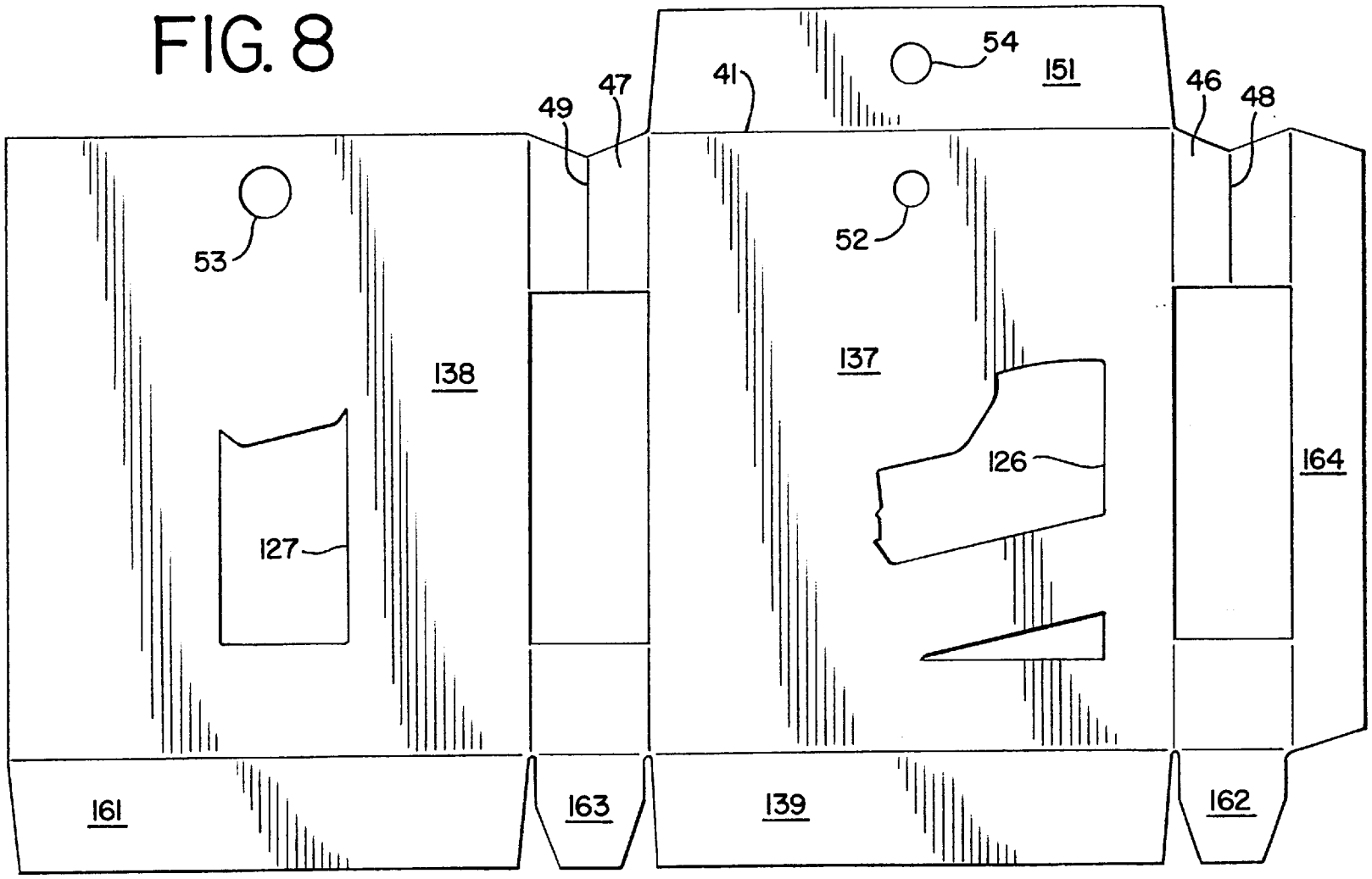
FIG. 8 is a plan view of a blank for making the carton as shown in the FIG. 5 embodiment.

With further reference to the tent-style configuration of the carton 23, gussets 46, 47 are provided at the upper portion of the carton at its opposing ends. Each gusset is comprised of a reentrant fold portion of the carton material having a respective fold line 48, 49 (FIG. 8). As is generally known in the art, this gusset and its reentrant fold structure contribute to the formation of a tent-style carton which is generally shown in the drawings.

It will be noted that tent-style paperboard carton 23 both protects the flexible pouch and provides a substantial surface area upon which indicia, product information, promotional displays, and the like can be presented in a comfortably spaced fashion. The presentation provided by the combined package according to the invention also is advantageous in that the food product is attractively displayed in order to enhance appetite appeal. These advantages are over and above those provided by the food product which is merchandised in the uncartoned flexible pouch. Advantageously, this is achieved without the need to adjust merchandiser sizing and without having to design a differently sized or configured flexible pouch. The width of the tent-style carton 23, and thus the width of the entire combination package, closely fits within the per package facing spacing which is afforded within retail merchandising equipment. The spacial relationship of this combination can assist in properly positioning the package combination within the merchandiser, typically also assisting in maintaining vertical support of the packages.

Turning now to FIG. 8, a blank is shown which can be used to construct the tent-style carton 23 which is shown in FIGS. 3, 4, 5, 6 and 7. Illustrated blank includes a front face panel portion 137 having a window 126, as well as a back face panel portion 138 having a window 127. A bottom panel portion 139 is provided for folding over an inside bottom flap portion 161, as well as inside end flap portions 162 and 163. Portions 139, 161, 162 and 163 are positioned so as to be folded and joined into the bottom portion of the tent-style carton which is made from this blank. Gusset portions 46 and 47 having fold lines 48 and 49 are shown as providing the gussets of the tent-style carton as discussed herein. In addition, an overflap portion 151 defines the top edge 41 of the assembled tent-style carton 23. In the illustrated blank, this top edge 41 is demarcated as a fold line. An assembly flap portion 164 of the blank is provided for secure attachment to the inside surface of the back face panel portion 138 in the finished tent-style carton.

Figure 6:
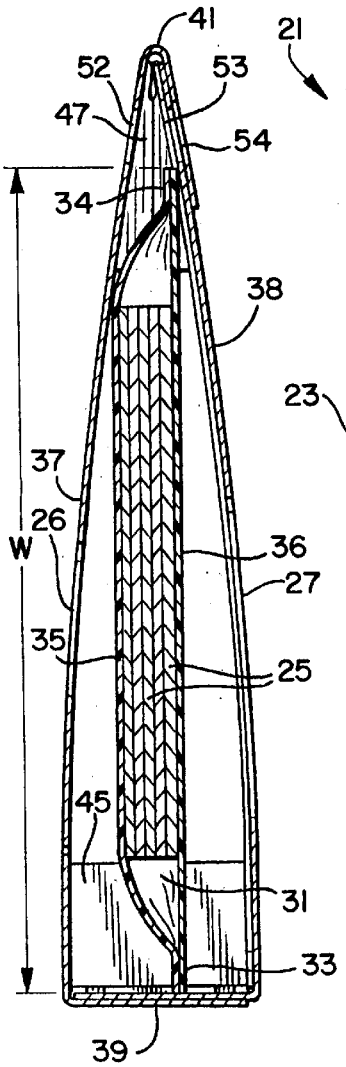
FIG. 6 is a longitudinal or vertical cross-sectional view through the embodiment illustrated in FIG. 5.
Figure 7:
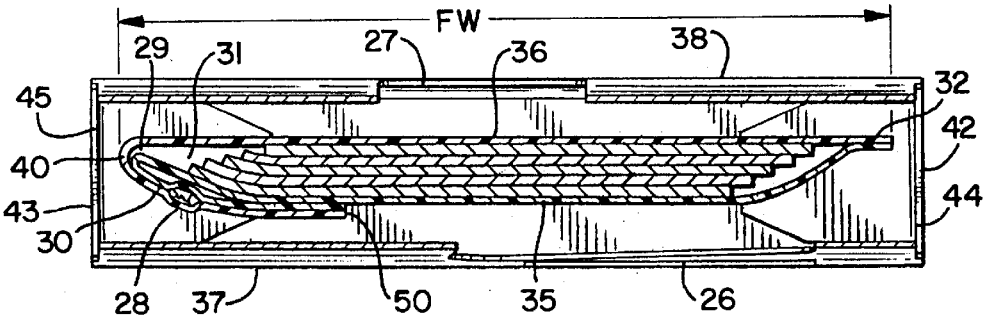
FIG. 7 is a transverse or horizontal cross-sectional view through the embodiment of FIG. 5.

Peg holes 52, 53 and 54 are included the blank as shown to form the peg receiving opening shown in FIGS. 5 and 6. It will be appreciated that the combination package according to the invention, when these peg holes are provided, will be supported and aligned by having a generally horizontal merchandiser peg (not shown) pass through the peg receiving opening for display and easy removal from the merchandiser by the consumer.

Figure 2:
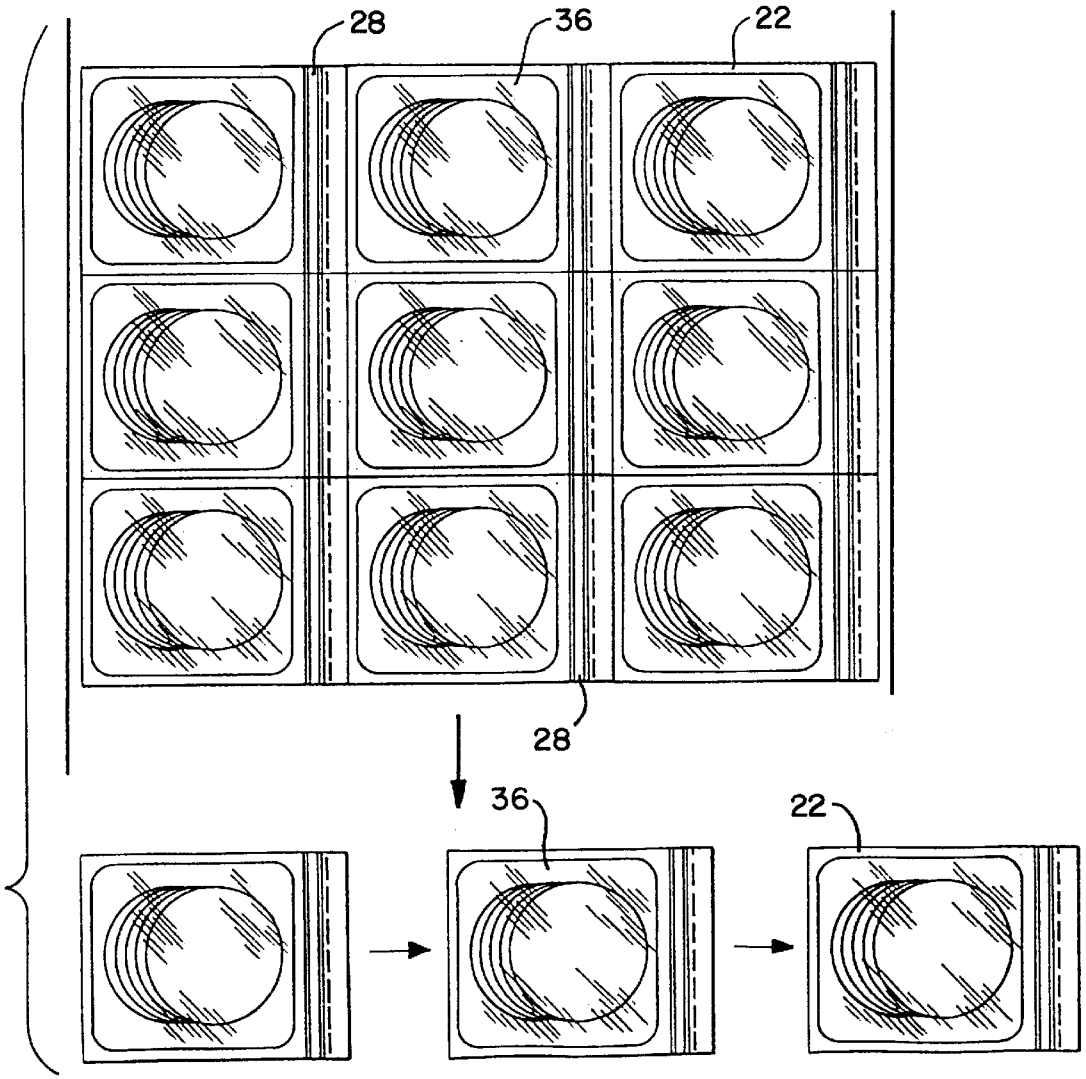
FIG. 2 is a conceptual illustration of a pouch forming and filling machine and of a takeaway component associated with such a machine
Figure 1:
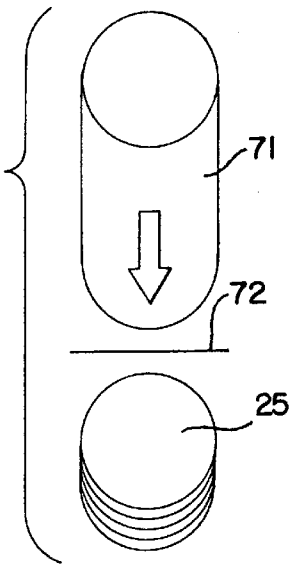
FIG. 1 is a generally schematic view illustrating a meat stick slicer and a resulting stack of meat slices.
Figure 3:
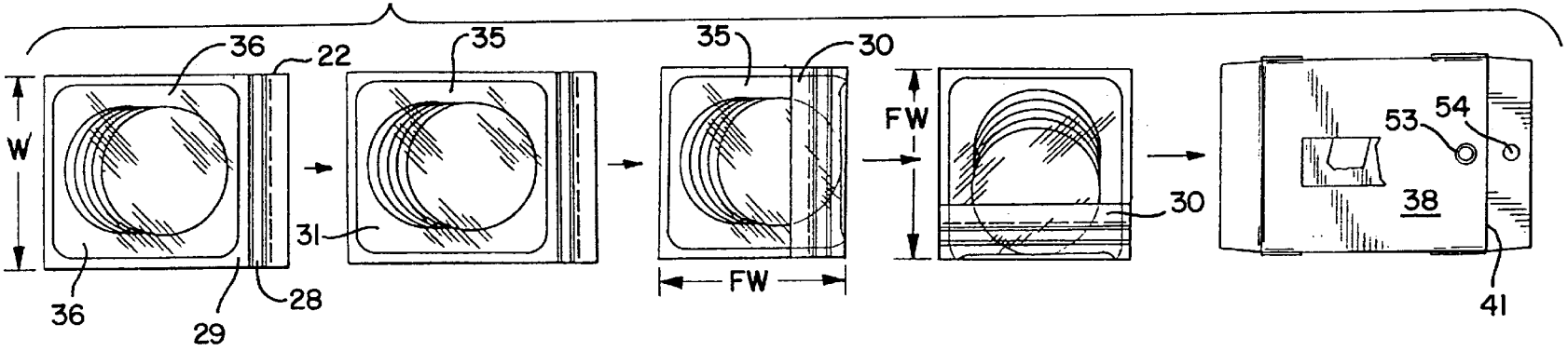
FIG. 3 is a conceptual illustration of a typical change in orientation of a formed, filled and sealed pouch and its subsequent insertion into a partially formed tent-style carton.
Figure 4:
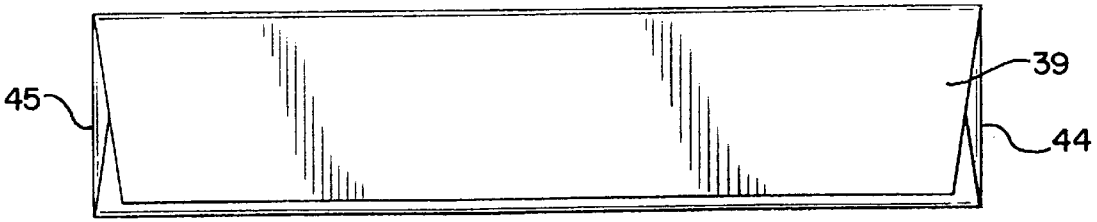
FIG. 4 is a bottom view of a tent-style carton, IS with its bottom end being closed.

FIG. 1, FIG. 2 and FIG. 3 illustrate the procedure of assembling the packaged product which enables peg display of a food pouch within a tent-style paperboard carton. These drawings illustrate assembly when the food product is a stack of meat slices. It will be appreciated that the packaging features and most of the procedure features also apply when the food product is not a sliced product. FIG. 1 shows a stick of meat 71 schematically oriented for passage through a slicer having a slicing blade 72 in order to provide a stack of slices 25. This slicing and stacking is carried out in accordance with generally known procedures and with commercially available equipment. As an example, slices 25 can form a 5.5 ounce draft of slices. Slices 25 are inserted into and hermetically sealed within one or more flexible pouches 22. In a typical approach, the pouch is formed and the slices are inserted by commercially available equipment such as that marketed by Multivac.

In the arrangement illustrated in FIG. 2, the pouch has a formed side and a non-formed side. An array of filed pouches are shown, with their non-formed side 36 facing upwardly as shown. The machine direction is in accordance with the illustrated arrowhead. The formed, filled and sealed flexible pouches 22 move away from the forming and filling machine. In the illustrated embodiment, this takeaway flow is in a direction at right angles from the flow of the forming, filling and sealing machine. Filled flexible pouches 22 are then manipulated as illustrated in FIG. 3 and inserted into an open carton which will be closed and sealed to provide the tent-style paperboard carton.

In accomplishing the procedure in the preferred embodiment, the pouch 22 is flipped over so that the flat, non-forming film or side 36 faces down, and the forming film or side 35 faces up. In addition, the mouth portion of the pouch is folded back on itself to provide the pouch folded area 30 which is shown in FIG. 3. These orienting steps may be in any order. The flexible pouch then is filled into the carton. In these steps, the pouch is inverted, if necessary, in order to provide the desired orientation of the pouch within the carton. Inversion could, for example, arrange the pouch such that the forming side is up. In the illustrated embodiment, the forming side of the flexible pouch is shown for orientation with the back panel 38 of the carton-forming member. Further in accordance with these steps of the present invention, the flexible pouch is oriented, such as by rotating ninety degrees, for example in the clockwise direction. By whatever procedure details are followed, the width FW of the pouch is small enough so as to accommodate entry of the flexible pouch and its folded mouth area into the open carton as is generally apparent in FIG. 3. As generally noted in FIG. 3, the carton indexes at right angles with respect to the illustrated flow of the filled flexible pouches.

In an illustrated embodiment of this procedure, the portion of the formed, filled and sealed flexible pouch which contains the strip is folded back onto itself, toward the non-forming side of the pouch. Thereafter, the package is inverted so that the non-forming side faces in the opposite direction, such as downwardly. The entire inverted package is then rotated ninety degrees in a clockwise direction before it is passed into the open carton. It will be appreciated that other variations in this procedure are possible, in accordance with the particular needs of the package and/or equipment.

It will be understood that the embodiments of the present invention which have been described are illustrative of some of the applications of the principles of the present invention. Numerous modifications may be made by those skilled in the art without departing from the true spirit and scope of the invention.

We claim:

1. A food package combination of a food-containing pouch within a tent-style carton, the combination comprising:

a flexible pouch having a front panel, a rear panel, and sealed edge portions which seal together said front panel and said rear panel to provide a product cavity;

said flexible pouch having an access opening into said product cavity, said access opening being generally at a mouth portion of the flexible pouch;

a strip at said mouth portion, said strip providing selective opening and reclosing for said access opening;

a food product within said product cavity of the flexible pouch, which food product is removable, in whole or in part, from said flexible pouch through said access opening when said strip is opened;

a tent-style carton having a front face, a back face, a bottom face and a top edge, said faces and edge being oriented with respect to each other to delineate opposing end areas which are each of generally triangular configuration having an apex at said top edge;

a narrow top portion of said tent-style carton, said narrow top portion of the tent-style carton being defined by said top edge thereof and by a top portion of each of said front and back faces of the carton;

said mouth portion having said strip is folded over 180 degrees back onto the pouch while accommodating said food product within the product cavity so as to define a pouch folded area; and said pouch is oriented 90 degrees from said carton such that said pouch folded area extends between said top edge and said bottom face of the carton while an end portion only of said pouch folded area is within said narrow top portion of the tent-style carton.

2. The food package combination in accordance with claim 1, wherein said food product comprises a plurality of food pieces.

3. The food package combination in accordance with claim 1, wherein said strip is a zipper strip having a plurality of opposing interlocking profiles.

4. The food package combination in accordance with claim 1, wherein at least one of said opposing end areas of generally triangular configuration includes a reentrant fold gusset portion having a reentrant face, said reentrant face and a portion of said tent-style carton directly opposite to said reentrant face provide a gripping section of said carton portion, and wherein only an end portion of said flexible pouch is engaged by said gripping section of the tent-style carton.

5. The food package combination in accordance with claim 1, wherein said pouch folded area is delineated from the product cavity by a fold line.

6. The food package combination in accordance with claim 5, wherein said tent-style carton has a given width which is equal to or greater than a folded width FW of said flexible pouch, said folded width FW being defined between said fold line and one of said sealed edge portions of the flexible pouch, namely one sealed edge portion which is substantially parallel to said fold line.

7. The food package combination in accordance with claim 6, wherein said flexible pouch has an unfolded width W which is greater than said folded width FW, said unfolded width W being measured in a direction substantially perpendicular to said folded width FW.

8. The food package combination in accordance with claim 1, wherein said tent-style carton includes a peg hole closely spaced from its said top edge, and wherein said flexible pouch is devoid of any peg hole.

9. A food package combination of a food-containing pouch within a tent-style carton, the combination comprising:

a flexible pouch having a front panel, a rear panel, and edge portions which seal together said front panel and said rear panel to provide a product cavity;

said flexible pouch having an access opening into said product cavity, said access opening being generally at a mouth portion of the flexible pouch;

a strip at said mouth portion, said strip providing selective opening and reclosing for said access opening;

a food product within said product cavity of the flexible pouch, which food product is removable, in whole or in part, from said flexible pouch through said access opening when said strip is open;

said mouth portion having said strip is folded over 180 degrees back onto said pouch, said food product being within said product cavity and not within said mouth portion, said mouth portion being a pouch folded area;

a fold line between said mouth portion and said product cavity, said fold line and a sealed edge portion parallel thereto having defined therebetween a folded width FW of the pouch;

a tent-style carton having a front face, a back face, a bottom face and a top edge, said faces and edge being oriented with respect to each other to delineate a generally triangular vertical cross-section; and said pouch is oriented 90 degrees with respect to said tent-style carton such that said strip is generally perpendicular to said edge of the tent-style carton, and said tent-style carton has a width which is equal to or greater than said folded width FW of the flexible pouch.

10. The food package combination in accordance with claim 9, wherein said flexible pouch has an unfolded width W which is greater than said folded width FW.

11. The food package combination in accordance with claim 9, wherein said tent-style carton includes a peg hole closely spaced from its said top edge, and wherein said flexible pouch is devoid of any peg hole.

12. A process for providing a food package combination of a food-containing pouch within a Lent-style carton, comprising the steps of:

providing a flexible pouch and inserting a food product therewithin, including forming the flexible pouch as one having a front panel, a rear panel and sealed edge portions which seal together the front panel and the rear panel to provide a product cavity, an access opening and a mouth portion having a strip to provide selective opening and reclosing for the access opening;

folding over a portion of the pouch 180 degrees back onto itself, said portion being the mouth portion having the access opening and strip while accommodating the food product within the product cavity in order to provide a folded-over flexible pouch;

providing an open tent-type carton having a front face, a back face, a bottom portion and a top edge;

orienting said folded-over flexible pouch and said open tent-type carton relative to each other so that the strip of the folded-over mouth portion is generally perpendicular to the top edge of the carton, and inserting the folded-over flexible pouch into the open tent-style carton at this orientation; and closing said open tent-style carton with said thus oriented folded-over flexible pouch therewithin in order to provide a closed combination tent-style carton with the food-containing pouch enclosed therein such that the folded area of the pouch extends between the top edge and a bottom portion of the tent-style carton.

13. The process in accordance with claim 12, wherein the tent-style carton has opposing end areas of generally triangular configuration having an apex at the top edge and a narrow top portion defined by the top edge and by a top portion of each of the front and back faces of the carton, and said closing step includes positioning an end portion only of said pouch folded area within the narrow top portion of the tent-style carton.

14. The process in accordance with claim 12, wherein said folding step provides a flexible pouch having a folded width FW which is equal to or less than the width of the tent-style carton.

15. The process in accordance with claim 12, wherein said folding step provides a flexible pouch having a folded width FW which is less than the width of the tent-style carton.

16. The process in accordance with claim 12, further including inverting the flexible pouch having the food product therewithin so as to reverse the front and back orientation of the pouch with respect to the open tent-type carton, said inverting step taking place prior to said inserting of the pouch into the carton.

* * * * *

UNITED STATES PATENT AND TRADEMARK OFFICE

CERTIFICATE OF CORRECTION

PATENT NO. : 6,063,416
DATED : May 16, 2000
INVENTOR(S) : Arthur C. Teasdale and Stephen P. Wilcox It is certified that error appears in the above-identified patent and that said Letters Patent is hereby corrected as shown below:

Column 1,
Line 15, delete "arid" and insert --and--.

Column 2,
Line 25, delete "Least" and insert --least--.

Column 3,
Line 3, "of present" should read --of the present--;
Line 27, "of description" should read --of the description--;
Line 33, insert a semicolon --;-- after "machine";
Line 39, delete "IS".

Column 4,
Line 14, "nor-forming" should read --non-forming--.

Column 5,
Line 43, "included the" should read --included in the --.

Column 6,
Line 2, delete "filed" and insert --filled--.

UNITED STATES PATENT AND TRADEMARK OFFICE

CERTIFICATE OF CORRECTION

PATENT NO. : 6,063,416
DATED : May 16, 2000
INVENTOR(S) : Arthur C. Teasdale and Stephen P. Wilcox It is certified that error appears in the above-identified patent and that said Letters Patent is hereby corrected as shown below:

Column 8,
Line 25, "Lent-style" should read --tent-style--.

Signed and Sealed this

Third Day of July, 2001

*Attest:*

Nicholas P. Godici

*Attesting Officer*

NICHOLAS P. GODICI
*Acting Director of the United States Patent and Trademark Office*